US005228147A

United States Patent [19]

Fominaya Agullo

[11] Patent Number: 5,228,147

[45] Date of Patent: Jul. 20, 1993

[54] HYDROPNEUMATIC FLUSHER FOR TOILET TANKS

[76] Inventor: Pablo Fominaya Agullo, Partida de Saboya, 110, Alboraya (Valencia), Spain, 46120

[21] Appl. No.: 729,530

[22] Filed: Jul. 12, 1991

[30] Foreign Application Priority Data

Mar. 26, 1991 [SE] Sweden ..... 9100825

[51] Int. Cl.[5] ..... E03D 5/09; E03D 3/10

[52] U.S. Cl. ..... 4/407; 4/391

[58] Field of Search ..... 4/334, 335, 355, 356, 4/358, 359, 361, 362, 390, 391, 394, 405, 407, 249

[56] References Cited

U.S. PATENT DOCUMENTS

| | | | |
|---|---|---|---|
| 261,583 | 7/1882 | Coggin et al. | 4/362 |
| 542,485 | 7/1895 | Menzies | 4/391 |
| 926,155 | 6/1909 | Walls, Jr. | 4/356 |
| 2,632,180 | 3/1953 | Pegler | 4/407 X |
| 2,740,129 | 4/1956 | Braswell, Jr. | 4/407 X |
| 3,662,408 | 5/1972 | Knudtson | 4/407 |
| 3,987,501 | 10/1976 | Anderson | 4/407 X |
| 4,149,283 | 4/1979 | Knudtson | 4/249 X |
| 4,233,698 | 11/1980 | Martin | 4/356 X |
| 4,304,015 | 12/1981 | Hubatka | 4/407 |
| 4,486,906 | 12/1984 | Meier | 4/391 X |

FOREIGN PATENT DOCUMENTS

| | | | |
|---|---|---|---|
| 0563068 | 12/1957 | Belgium | 4/391 |
| 0833456 | 10/1938 | France | 4/407 |
| 2539778 | 7/1984 | France | 4/249 |
| 0206591 | 8/1939 | Switzerland | 4/391 |
| 0302469 | 10/1954 | Switzerland | 4/391 |
| 2065737 | 7/1981 | United Kingdom | 4/391 |

*Primary Examiner*—William A. Cuchlinski, Jr.
*Assistant Examiner*—John L. Beres
*Attorney, Agent, or Firm*—Darby & Darby

[57] ABSTRACT

The hood (1) has a tubular duct (2) in axial correspondence with the hole provided in the base thereof and in whose inside the overflow tube (3) is guided. Between the duct (2) and the side wall of the hood (1) the pneumatic chamber (11) in which the float (4) moves is formed.

The cock (19) filling the tank with water has in its radial connecting nozzle of the flexible tube (21) some outer axial direction grooves (22) that remain partially covered by said flexible tube (21), thus admitting air that will be provided with the water through the lower area of the hood (1), where the latter incorporates a connecting nozzle, the air raising between the interstices of the float (4) and hood (1) to fill the chamber (11).

The hood (1) includes in the bottom thereof a deflector (23) facing the water and air intake, to direct the latter towards the inside of the hood and the deflector (23) having an alternative air venthole.

3 Claims, 2 Drawing Sheets

HYDROPNEUMATIC FLUSHER FOR TOILET TANKS

OBJECT OF THE INVENTION

The present invention, as is expressed in the title of this specification, refers to a hydropneumatic flusher for toilet tanks, providing a series of relevant features as opposed to presently used flushers of this type.

Its purpose is to make it possible to flush water from a tank, whatever the filling level is, by means of the discharge of air stored in the hood which constitutes the body of the flusher.

BACKGROUND OF THE INVENTION

Tank flushers that comprise, as main constituent elements of the same, a hood inside of which there is a valve that closes upon the flushing inlet of the tank and that is displaced by traction, are known in prior art. The valve in question is integral with a rod generally tubular, that acts as an overflow tube. In the same way, in the so-called "low tanks," this is produced by traction but a float fastened on the overflow tube is included.

The operation of this type of the so-called hydropneumatic flushers is done by establishing a connection of the air chamber of the hood, with the atmosphere, through a duct provided in the end of a plug, operated by pushing, in such a way that a depression is produced in said chamber by a release of air, permitting the elevation of the float, by the water pressure, which pulls by traction the plug valve which opens the bottom inlet of the tank, causing the total flushing of the liquid that it contains.

In order to effect successive flushings it is necessary to wait, for the same have been carried out, until the float and valve drop to the closing position, in order for the tank to fill up.

Flushers of the type described also pose the problem that if upon establishing the communication of the air chamber with the outside, there is not enough water in the tank, there is a partial elevation of the valve pulled by the float, which insufficiently raises the plug rubber, producing a slight opening of the flusher inlet, thus, the water of the tank spills in the same proportion as it arrives through the filler duct, thus, the flusher remains nonusable, upon producing its balance between the water flow that enters and that which comes out of the tank.

Generally, in the cited case, the valve never recovers and the plugging system has to be operated by hand, which requires the air of an expert.

DESCRIPTION OF THE INVENTION

In order to solve the cited problems and especially to obtain the rapid recovery of the valve to the closing position, and to be able to produce successive flushings, the invention proposes a hydropneumatic flusher that uses the air injection system by pulling the same by means of the water vein that fills the tank, for which purpose it has been provided with constructive features with said purpose.

To this sense, the flusher consists of a hood inside which there is a float, furnished with a limited ascending and descending course, given by the height of the hood itself, whose float is axially pierced by a tubular rod which has in its bottom a narrowing which enables the raising of the overflow tube, to which the plugging system is connected and which upon raising produces the flushing. The tubular rod protrudes through the high part of the hood in the convenient length to act as an overflow tube. It is guided by a tubular duct connected to the hood itself and concentric to it, forming between both elements, tubular duct and the hood, the pneumatic chamber partially occupied by the float, whose pneumatic chamber extends from the base of the tubular duct that guides the overflow tube and float, until the highest part of the hood.

The float and the overflow tube are independent, though they are loosely connected, and in such a way that the raising of the float also determines the raising of the valve and overflow tube, in the same way that the drop of one also determines the drop of the other.

After carrying out a flushing of liquid of the tank, the cited principle of injection of air, pulled by the flow of water that feeds the tank, enters into operation. For this purpose, there are one or more capillary ducts made up of outer axial grooves that remain partially covered by the conduit that carries the water to the inside of the tank, provided at the outlet of the filler duct of the supply installation.

This duct, in its final section is connected to the hood and its bottom part remains inside the same in the exact point where the injection of air takes place, preferably at a level slightly higher than the position of the openings through which the water flushes, so that the air injected by means of the water flow, is raised by itself, passing through interstices of the float and hood, in order to accumulate inside.

Opposite the outlet of this water and air intake duct, there is a deflector provided which diverts the air pulled by the water towards the inside of the hood. Said deflector includes in axial prolongation of the inlet duct, an alternative air venthole.

The high part of the hood is provided with an outlet by which there is connection between the pneumatic chamber and the atmosphere, when it is desired to cause the corresponding depression for the purpose of causing the raising of the float and valve, to flush the tank.

This outlet is eventually closed by a pusher-rod, provided with a spring that keeps it in the closing position.

In order to facilitate the understanding of the features of the invention and forming an integral part of this specification, two sheets of drawings are attached, whose figures, with an illustration and non-restrictive manner represent the following:

DESCRIPTION OF A PREFERRED EMBODIMENT

Figure 1:
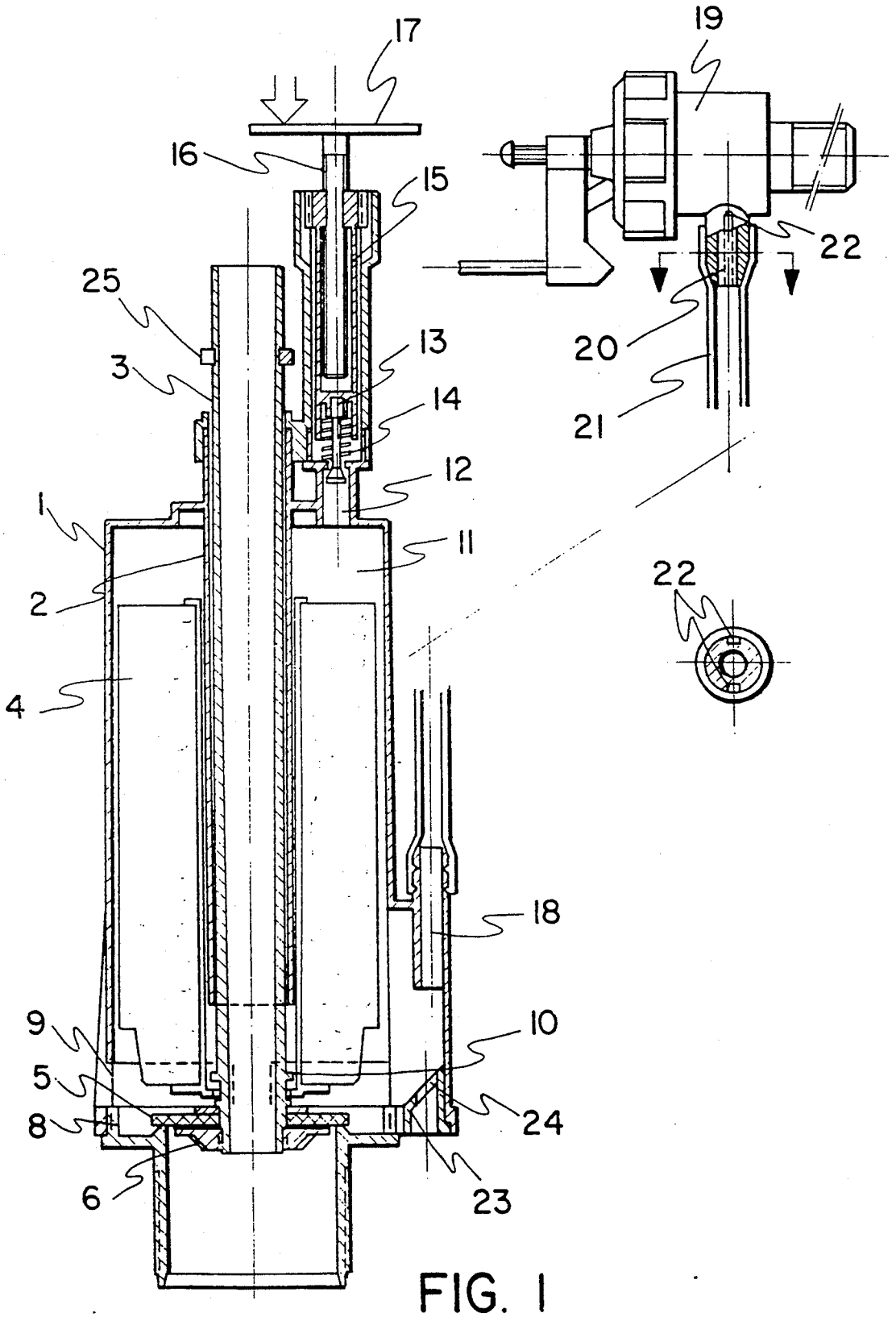
FIG. 1. It shows the flusher, seen in vertical section and in the inoperative position, in other words, with the float and valve in the action of closing the flushing inlet.
Figure 2:
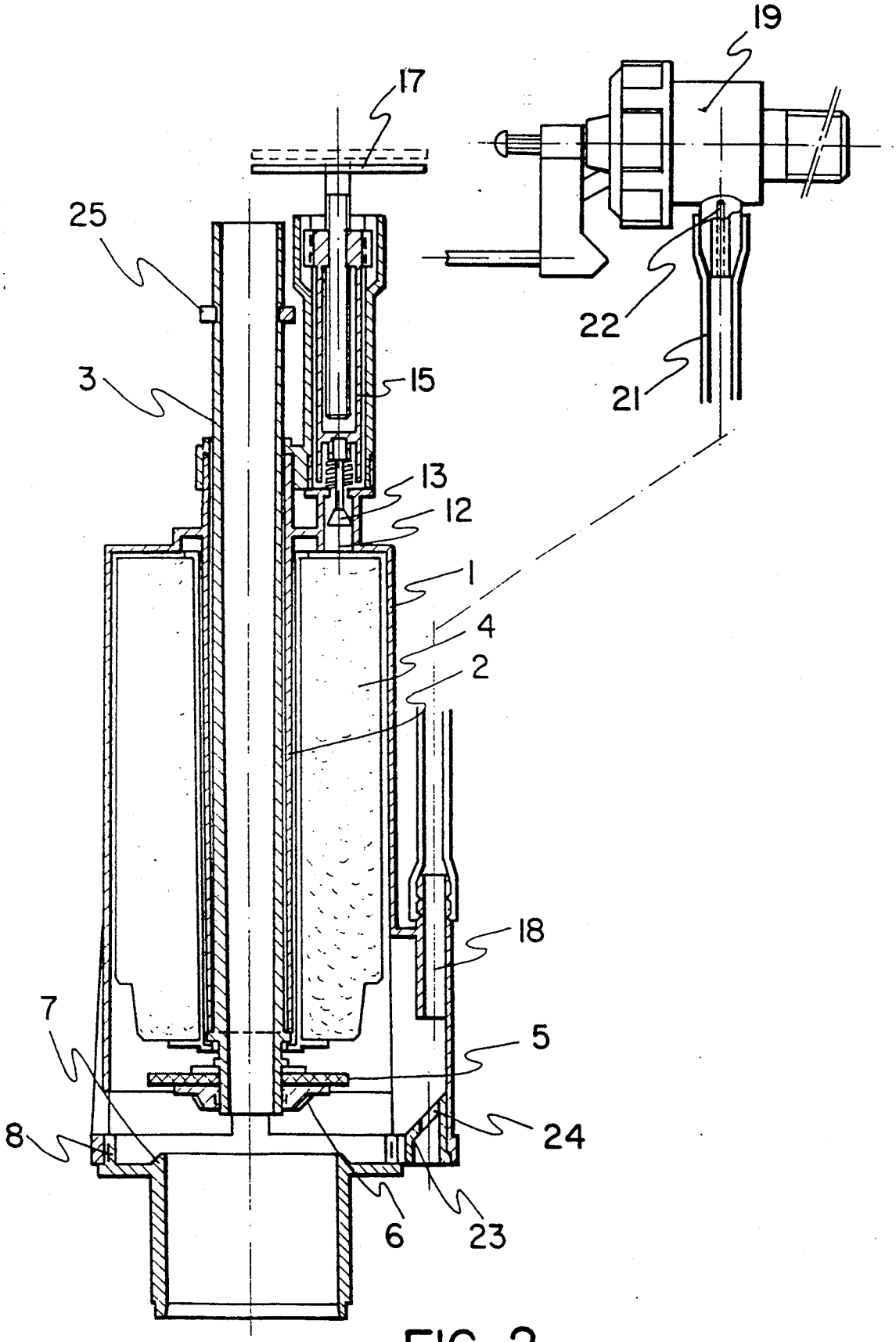
FIG. 2. It shows the vertical section view of the flusher with the float and valve raised, leaving the flushing inlet open.

Making reference to the numbering used in the figures, we can see how the hydropneumatic flusher for toilet tanks, which the invention proposes, consists of a hood-shaped body 1 with a central axial hole in correspondence with which there is a tubular axial prolongation 2 inside which slides the overflow tube 3. Outside of the tubular prolongation 2 of the hood-shaped body 1 and inside the later, the annular shaped float 4 can move vertically. The bottom end of the overflow tube 3 receives the flat valve 5 retained by nut 6, closing this valve 5 over the coupling which constitutes the liquid flushing inlet. This coupling forms a concentric peripheral edge 8 upon which the hood 1 screws. The hood 1 is provided with openings 9 through which the water of the tank precipitates through the coupling, when the plug valve 5 has been raised.

The overflow tube 3 has near the plug valve 5 a stop 10 which in combination with the narrowing that there is in the bottom part of the float 4, determines the height of the overflow tube 3 and consequently of the plugging system, when water enters inside the hood 1.

The pneumatic chamber 11 which defines the inside of the hood 1, has a connection 12 with the outside, at the high part of the same, eventually remaining closed by a valve 13 which tends to be kept in the closed position by action of the coaxial spring 14 and in prolongation of a push body 15 to which the shank 16 of a pusher 17 is screwed which can be regulated in extension. The closing can be produced in the hood itself 1, as well as in the push system.

In a position slightly raised with regard to the openings 9 of the hood, the latter has been provided with a water intake duct 18, connected with the filler cock 19, the latter having in its radial extension 20 for connection of the water intake flexible tube 21, some capillary ducts formed by axial grooves 22 through which the water vein produces the injection of air in the inner base of the hood 1, raising itself through the interstices between float 4 and blood 1.

Opposite the water duct outlet 18 of hood 1, there is a deflector 23 which diverts the air pulled by the liquid towards the inside of the hood, facilitating its ascent. This deflector includes in axial prolongation of said duct 18, an alternative air venthole 24.

The tubular rod 3 projects through the high part of the hood 1 in order to act as an overflow tube. In its outer section it is provided with a ring 25 with stop functions that prevent movement of the overflow tube 3 during assembly of the tank.

I claim:

1. A hydropneumatic flusher for use in the water storage tank of a toilet, said tank having a water outlet in the bottom thereof, said flusher comprising:

a hood having a cylindrical wall and a base integral with one edge of said cylindrical wall;

a tubular duct integral with and penetrating said baase, said duct having an upper end and a lower end, said duct forming a pneumatic chamber between said duct and said cylindrical wall, said chamber extending from the lower end of said duct to said base;

a tubular rod slidably positioned within said tubular duct, said tubular rod having a bottom;

sealing means integral with the bottom of said tubular rod for selectively closing the water outlet of the tank;

a float slidably mounted at least partially within said chamber, said float being connected to said shaft;

means for filling said tank, said means for filling being integral with said hood and providing air and liquid to said hood, said means for filling being positioned such that at least a portion of said air will be trapped in said chamber; and means for releasing air from said chamber, said means for releasing being mounted on said hood so that upon actuation of said means for releasing, air will be released from said chamber and water will enter said chamber; said water causing said float and said shaft to rise.

2. A hydropneumatic flusher as in claim 1, further comprising a deflector, said means for filling having an intake, said deflector being mounted opposite said intake for deflecting a substantial portion of said air towards said chamber.

3. A hydropneumatic flusher as in claim 1, wherein said means for filling comprises a water source inlet inserted into an inlet tube, said inlet tube being integral with said hood, said water source inlet having at least one exterior groove extending partially into said inlet tube such that air will be drawn into said inlet tube as water is injected through said water source inlet said inlet tube.

* * * * *

UNITED STATES PATENT AND TRADEMARK OFFICE

CERTIFICATE OF CORRECTION

PATENT NO. : 5,228,147

DATED : July 20, 1993

INVENTOR(S) : Pablo Fominaya Agullo

It is certified that error appears in the above-identified patent and that said Letters Patent is hereby corrected as shown below:

On the Title Page, Item [30];
Change "Mar. 26, 1991 [SE] Sweden ..... 9100825" to
--Mar. 26, 1991 [ES] Spain ..... 9100825--.

Signed and Sealed this

Twenty-first Day of June, 1994

*Attest:*

Bruce Lehman

BRUCE LEHMAN

*Attesting Officer*

*Commissioner of Patents and Trademarks*